United States Patent [19]

Moroishi et al.

[11] 4,140,526

[45] Feb. 20, 1979

[54] FERRITIC STAINLESS STEEL HAVING IMPROVED WELDABILITY AND OXIDATION RESISTANCE

[75] Inventors: Taishi Moroishi; Isamu Koizumi; Hisao Fujikawa; Hirofumi Makiura, all of Amagasaki; Yuji Shoji, Joetsu, all of Japan

[73] Assignees: Sumitomo Metal Industries, Ltd., Osaka; Nippon Stainless Steel Co., Ltd., Tokyo, both of Japan

[21] Appl. No.: 849,318

[22] Filed: Nov. 7, 1977

[30] Foreign Application Priority Data

Nov. 12, 1976 [JP] Japan ..... 51-136792

[51] Int. Cl.[2] ..... C22C 38/28

[52] U.S. Cl. ..... 75/126 F; 75/126 J

[58] Field of Search ..... 75/126 R, 126 F, 126 J; 148/37

[56] References Cited

U.S. PATENT DOCUMENTS

| | | | |
|---|---|---|---|
| 2,703,661 | 3/1955 | Taylor | 75/126 F |
| 3,000,730 | 9/1961 | Tanczyn | 75/126 F |
| 3,799,765 | 3/1974 | Clarke, Jr. | 75/126 F |
| 3,813,240 | 5/1974 | Abe | 75/126 F |
| 3,852,063 | 12/1974 | Niimi et al. | 75/126 D |
| 4,010,049 | 3/1977 | Rarey | 148/37 |

FOREIGN PATENT DOCUMENTS

| | | | |
|---|---|---|---|
| 50-10528 | 4/1975 | Japan | 75/126 F |

*Primary Examiner*—Arthur J. Steiner
*Attorney, Agent, or Firm*—Flynn & Frishauf

[57] ABSTRACT

A ferritic stainless steel having improved weldability and oxidation resistance, consisting essentially of 11.0 – 20.0% by weight of Cr, less than 0.10% by weight of C, less than 1.5% by weight of Si, less than 1.5% by weight of Mn, less than 1.5% by weight of Zr, the ratio of (Zr%)/(C% + N%) being higher than 7, and the balance of Fe, and the nitrogen amount being restricted to less than 0.015% by weight.

8 Claims, 2 Drawing Figures

FERRITIC STAINLESS STEEL HAVING IMPROVED WELDABILITY AND OXIDATION RESISTANCE

BACKGROUND OF THE INVENTION

The present invention relates to a heat resistant ferritic stainless steel having improved weldability, particularly for use in articles, in which improved weldability as well as resistance to oxidation at high temperatures are required, such as a recuperator of an exhaust gas converter of automobiles and other kinds of gas combustion means.

Ferritic stainless steels, a typical one of which is the JIS SUS 430 steel corresponding to the AISI Type 430 steel, have been widely used for building materials, kitchen utensils, automobiles, etc., since such type steels are less expensive than austenitic stainless steels. The ferritic stainless steel, however, does not have good heat resistance within the temperature range of 900–1000° C., and if it is subjected to a thermal cycle of heating and cooling, the spalling of scale becomes serious even at temperatures about 800–900° C. Thus, the ferritic steel has been considered unsuitable for use in the exhaust gas converter of automobiles, since scale might clog such an apparatus.

Austenitic stainless steels such as JIS SUS 304 (AISI Type 304) are superior to the ferritic stainless steel in their resistance to heat. However, when the austenitic stainless steel is employed together with a carbon steel or low alloy steel, there is a danger of collapse of an assembly during service due to the large difference in their thermal expansion coefficients. Since the thermal expansion coefficient of the ferritic stainless steel is very similar to that of carbon steel, for example, in case of an automobile exhaust gas converter comprising an inner cylinder of a heat resistant steel and an outer cylinder of a carbon steel, it is desirable to make the inner cylinder out of the ferritic stainless steel. However, as already mentioned, the conventional ferritic stainless steel has inferior heat resistance. In addition, the weldability of the conventional ferritic stainless steel is unsatisfactory, so it is not suitable for the fabrication of complicated articles. Thus, it has been recognized that it is not feasible to apply the ferritic steel to such a purpose.

PRIOR ART TO THE INVENTION

Japanese Patent Publication No. 3927/1973 discloses a heat resistant alloy comprising 15 - 30% by weight of Cr, 2 - 7% by weight of Al and the balance of Fe. The alloy may contain in addition thereto at least one of Ti, Zr, Ce and Y in a total amount of not more than 1% by weight. Since the alloy is intended for use in an atomsphere including lead oxide (PbO), it comprises as high as 2 - 7% by weight of Al. Such a high Al content makes the alloy so hard that it is very difficult to work it. The weldability thereof is poor, too. Therefore, the alloy cannot be used for the purpose of the present invention wherein not only workability but also weldability are required. Since Y and rare earth metals such as Ce are easily oxidized, it is very difficult to incorporate these additives in the melt of steel and thus the production of the alloy is not practical.

On the other hand, a ferritic stainless steel containing Zr is disclosed in Japanese Patent Publication No. 14586/1968, "Electric Furnace Conference Proceedings" Vol. 19, 1961, AIMI pp. 70 - 88, and Japanese Patent Publication No. 35418/1970. The Japanese Patent Publication No. 14586/1968 utilizes the addition of Zr so as to prevent the ridging (or roping) of ferritic stainless steels, but it does not disclose anything about the influence of Zr on heat resistance and weldability. Furthermore, according to the working example thereof, the ratio of (Zr%) to (C% + N%) is very small, and therefore, the improvement of heat resistance cannot be expected from this reference. "Electric Furnace Conference Proceedings" pp. 70 - 88 teaches the addition of Zr in order to reduce the ridging, too. It does not mention anything about the improvement in heat resistance and weldability. Japanese Patent Publication No. 35418/1970 discloses a free machining steel of the type of ferritic stainless steel containing 0.20 - 0.55% by weight of sulfur. It also includes Zr together with Mo in a total amount of not more than 2.0% by weight in order to improve high temperature ductility.

The publication, Japanese Patent Disclosure No. 146512/1975 is the closest to the present invention and it belongs to one of the assignees of the present application. This prior application discloses a ferritic stainless steel comprising 11.0 - 20.0% by weight of Cr, 0.01 - 0.10% by weight of C, not more than 1.5% by weight of Si, not more than 1.5% by weight of Mn, 0.10 - 1.5% by weight of Zr and the balance of iron. The Zr is added for the purpose of further improving oxidation resistance, cold workability and weldability. This prior application, however, teaches nothing about the technical significance in maintaining the ratio of Zr% to (C% + N%) at higher than 7. The behaviour and influence of C and N on the properties of the resulting alloy steel were not investigated nor recognized. In fact, the N content is not limited and is allowed to be present in such an amount as in the conventional ferritic stainless steel (i.e. about 0.02 - 0.03% by weight).

Thus, though stainless steels containing Zr have been known in the art prior to the present invention, and the purpose of the addition of Zr is to improve workability and oxidation resistance. No consideration was given to the relation of the Zr content with the content of C plus N, and therefore, satisfactory improvement in oxidation resistance at high temperature, workability and weldability was not obtained by the addition of Zr. In addition, U.S. Pat. No. 3,992,198 discloses a ferritic stainless steel containing 19 - 35% by weight of Cr, in which the amount of N plus C is limited. The alloy of this U.S. Patent further contains Ti and Al, but not Zr. In spite of the fact that the amount of N and C is limited, the limitation is made for the purpose of avoiding brittleness after welding and of improving the resistance to wet corrosion (i.e. intergranular corrosion). It does not say anything about dry corrosion (i.e. the resistance to high temperature oxidation).

SUMMARY OF THE INVENTION

A principal object of the present invention is to provide a ferritic stainless steel having improved oxidation resistance at high temperatures, in combination with improved cold workability and weldability, especially useful for making an article to be used at high temperatures, such as an article of an exhaust gas converter of automobiles.

DETAILED DESCRIPTION OF THE PREFERRED EMBODIMENTS

Figure 1:
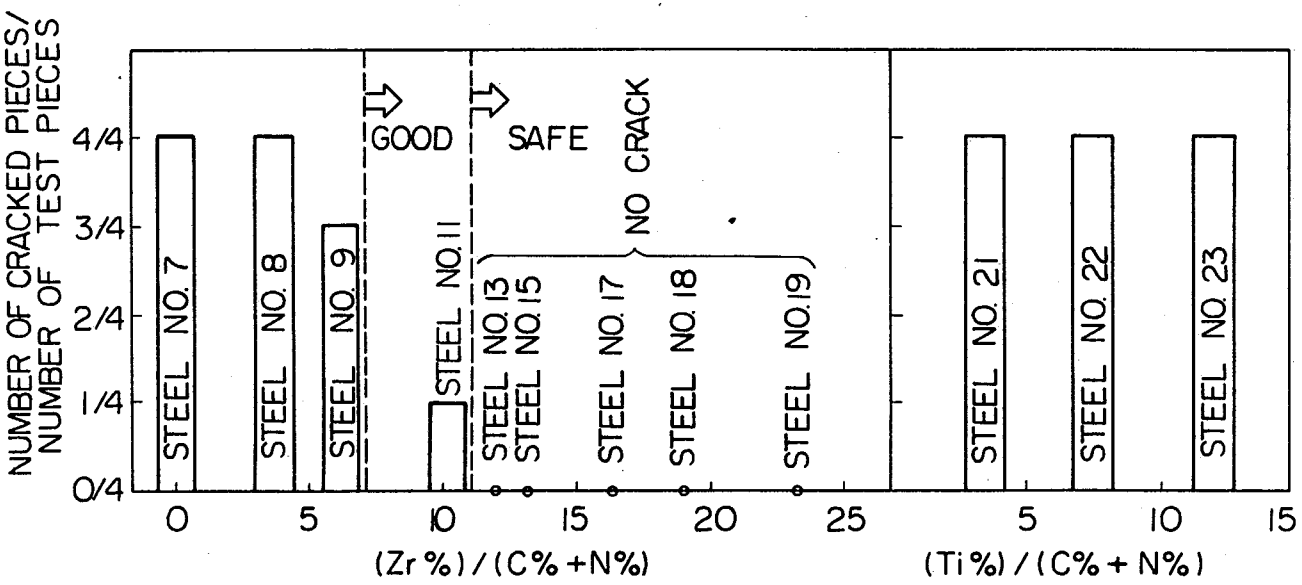
FIGS. 1 and 2 are graphs showing the test results of Examples 2 and 3, respectively.

The present invention resides in the ferritic stainless steel composition consisting essentially of:

Cr 11.0 - 20.0% by weight
C less than 0.10% by weight
Si less than 1.5% by weight
Mn less than 1.5% by weight
Zr less than 1.5% by weight
the ratio of (Zr%)/(C% + N%) higher than 7, and
Fe balance with incidental impurities
and the nitrogen content being limited to less than 0.015% by weight.

The present invention is based on findings that it is necessary to limit the N content as low as possible in order to satisfy all of the desirable properties mentioned above, and that a harmful influence of N and C can successfully be overcome by incorporating a suitable amount of Zr so that an improved ferritic stainless steel is obtained with unexpectedly high properties.

According to our investigation on the harmful influence of N and C on the oxidation resistance of a steel, it is said that C and N contained in a steel composition turn to gases upon heating at a temperature around 1000° C., which break a protective surface film of the steel. In addition, since N and C are extensive austenite formers, the N and C, if dissolved in the steel composition in a relatively large amount, form an austenitic phase at a temperature above about 850° C., resulting in duplex phase of austenite and ferrite, which does not show satisfactory resistance to oxidation at high temperatures. This is because the diffusion rate of Cr in the austenite phase is remarkably low compared to that in the ferrite phase, so that a sufficient supply of Cr to the surface through the diffusion of Cr is not expected. Therefore, the formation of a surface oxide film rich in Cr is not found in such a case. Accordingly, it is desirable to keep the N and C content of the ferritic stainless steel as low as possible.

It has also been found that the relationship of N to the properties of stainless steels is closer than expected and the effect of N is more severe than that of C. In addition to the influence of N on the resistance to oxidation, it has an effect on workability, since the higher the N content becomes, the more the nitride forms, which degrades the cleanliness of the steel, resulting in poor workability. If a much amount of N is included in a steel, the amount of Zr required to remove the harmful effect of the N increases. But, an excessive content of Zr not only renders the matrix to be brittle, but also pushes the production cost up.

Thus, according to the present invention, the N content is made as low as possible through careful treatment of the melt, such as Vacuum Melting process, VOD process, AOD process etc., the allowable maximum of which is 0.015% by weight, which is much less than that contained in the conventional ferritic stainless steel.

By the way, it is known in the art that Zr tends to form a carbide and a nitride with C and N. The Zr added to an alloy composition easily forms carbide and nitride to remove the harmful influence of N and C which are included in the alloy composition in a free state. Now, it has also been found that free Zr may improve adhesion of the protective surface oxide film rich in Cr. For this purpose, therefor, Zr must be contained in an amount more than the stoichiometrical amount of Zr which reacts with all the C and N dissolved in the alloy composition.

Thus, the essential features of the present invention are that the Zr content is not more than 1.5% by weight, and that the ratio of (Zr%)/(C% + N%) is maintained higher than 7, while keeping the N content as low as possible.

The reasons for limiting the content of each of the ingredients of the stainless steel of the present invention are as follows.

A chromium content of more than 11% by weight is required to ensure resistance to oxidation and corrosion, which is essentially desired for the stainless steel of the type of the present invention. The formability of the steel is degraded when the Cr content exceeds 20% by weight. The Cr content, therefore, is restricted to 11 - 20% by weight.

Silicon is added to a melt as a deoxidizer during the steel making process. A Si content of more than 1.5% by weight hardens the resultant alloy and the cold workability indicated by elongation is also degraded.

Manganese is added for the purpose of promoting the deoxidizing effect of Si. Mn has an effect to desirably modify nonmetallic inclusions to some extent when added together with Si. When Mn is added in an amount of more than 1.5% by weight, then the resultant alloy will become hard and difficult to work by cold working.

Carbon, to the contrary, influences the resistance to corrosion and oxidation, and weldability. Therefore, it is desirable to keep the C content as low as possible. From a technical viewpoint, it is possible to lower the carbon content to about 0.001% by weight. According to the present invention, in which Zr is added, carbon is allowed to be present in an amount of 0.10% by weight at the most, since the Zr added may remove a harmful influence of the C and N contents, as hereinafter mentioned in more detail.

The zirconium content is in the range of less than 1.5% by weight. The ratio of (Zr%)/(C% + N%) must be maintained at higher than 7. If the Zr content is more than 1.5% by weight, an intermetallic compound precipitates in the alloy matrix, resulting in the reduction of the toughness thereof. The addition of Zr can further improve the resistance to corrosion and heat, and the weldability of the stainless steel, which have been considerably improved due to the reduction in C and N contents to as low as possible. A residual amount of C and N, which is in a very small amount, will react with the Zr added to form stable compounds so that the harmful effect of N and C will completely be removed.

In addition, it is very important to determine the amount of Zr with respect to the C and N contents. Since the Zr is added to the alloy composition to form carbide (ZrC), nitride (ZrN) and caronitride (Zr(C,N), the amount of the Zr added is determined so that all of the C and N contained react with a portion of added Zr to form carbide. nitride, and carbonitride. Stoichiometrically, the amount of Zr present should be at least 7 times the total amount of C and N. That is to say, the ratio of (Zr%)/(C% + N%) must be higher than 7. The ratio is preferably higher than 10 . A residual excess amount of Zr, which does not react with N or C, serves to intensify the adhesion of the protective surface oxide film to the matrix phase, which may further improve the oxidation resistance at high temperature of the present invention steel.

The incidental impurities such as S and P may be present in amounts as in the conventional ferritic stainless steels.

The present invention will be described in more detail in conjunction with preferred embodiments of the invention.

EXAMPLE 1

In this example, the oxidation resistance of the present invention steel was investigated.

A series of steels having the compositions shown in Table 1 below were prepared through a vacuum melting process with a reduced nitrogen content. The steels were hot rolled and cold rolled into plates 1.5 mm in thickness. After heat treatment, plate-shaped test pieces were prepared.

These pieces were polished with Emery paper No. 0, degreased and washed.

Tests were conducted in air at the temperature of 900° C. for the alloys containing 11% by weight of Cr and at the temperature of 1000° C. for the alloys containing 18% by weight of Cr. The test includes 400 cycles of heating for 30 minutes at an indicated temperature and cooling to room temperature. According to this test, not only resistance to oxidation at high temperature, but the adhesion of scale can be evaluated. The test results in terms of weight gain are summarized in the Table below.

Table 1

| Steel | Chemical composition (% by weight) | | | | | | | Weight gain (mg/cm$^2$) | | |
|---|---|---|---|---|---|---|---|---|---|---|
| No. | C | Si | Mn | Cr | N | Zr | Zr/(C+N) | 900° C | 1000° C | |
| 1 | 0.013 | 0.39 | 0.54 | 12.45 | 0.009 | — | — | −13.92 | | comparative |
| 2 | 0.042 | 0.76 | 0.58 | 11.82 | 0.013 | 0.15 | 2.7 | −1.10 | | " |
| 3 | 0.015 | 1.42 | 0.53 | 11.33 | 0.009 | 0.18 | 7.5 | 1.16 | | |
| 4 | 0.027 | 0.94 | 0.57 | 11.71 | 0.009 | 0.36 | 10.0 | 1.78 | | |
| 5 | 0.020 | 1.31 | 0.50 | 11.76 | 0.015 | 0.42 | 12.0 | 1.54 | | |
| 6 | 0.040 | 0.49 | 0.56 | 11.09 | 0.008 | 0.71 | 14.8 | 1.89 | | |
| 7 | 0.005 | 1.11 | 0.31 | 17.22 | 0.007 | — | — | | −85.41 | comparative |
| 8 | 0.036 | 0.69 | 0.48 | 17.91 | 0.008 | 0.16 | 3.6 | | −42.16 | " |
| 9 | 0.050 | 0.67 | 0.65 | 17.60 | 0.015 | 0.40 | 6.2 | | −3.05 | " |
| 10 | 0.071 | 1.42 | 0.42 | 19.01 | 0.015 | 0.65 | 7.6 | | 2.06 | |
| 11 | 0.082 | 1.01 | 1.32 | 17.50 | 0.008 | 0.83 | 10.2 | | 2.54 | |
| 12 | 0.097 | 1.38 | 0.58 | 18.72 | 0.009 | 1.16 | 10.9 | | 2.61 | |
| 13 | 0.015 | 0.64 | 0.55 | 16.98 | 0.012 | 0.32 | 11.9 | | 2.49 | |
| 14 | 0.012 | 0.77 | 0.32 | 17.92 | 0.011 | 0.41 | 12.4 | | 2.51 | |
| 15 | 0.041 | 0.47 | 0.66 | 18.08 | 0.012 | 0.70 | 13.2 | | 3.01 | |
| 16 | 0.081 | 0.41 | 0.48 | 18.24 | 0.015 | 1.41 | 14.7 | | 2.87 | |
| 17 | 0.040 | 0.51 | 0.54 | 16.34 | 0.006 | 0.75 | 16.3 | | 2.49 | |
| 18 | 0.042 | 0.60 | 0.57 | 17.99 | 0.007 | 0.93 | 19.0 | | 2.41 | |
| 19 | 0.004 | 0.51 | 1.41 | 16.58 | 0.005 | 0.21 | 23.3 | | 2.53 | |
| 20 | 0.031 | 0.47 | 0.56 | 18.61 | 0.013 | 1.11 | 25.2 | | 2.28 | |
| 21 | 0.031 | 0.86 | 0.45 | 16.85 | 0.012 | Ti 0.15 | 3.5* | | −62.43 | comparative |
| 22 | 0.035 | 0.72 | 0.51 | 18.05 | 0.012 | Ti 0.35 | 7.5* | | −39.15 | " |
| 23 | 0.027 | 0.99 | 0.52 | 17.10 | 0.007 | Ti 0.41 | 12.0* | | −12.26 | " |

*(Ti%)/(C% + N%)

It is understood from the results shown in the Table above that the present invention alloy, in which the ratio of (Zr%)/(C% + N%) is higher than 7 with a N content being less than 0.015% by weight, successfully reduced the formation and spalling of scale. This is confirmed by small positive figures of the oxidation test results with respect to weight gain of the specimens.

Furthermore, comparative steel compositions containing Ti (Test Nos. 21 - 23) are significantly inferior to the present invention alloy steel in their oxidation resistance and scale adhesion, even when the ratio of (Ti%)/(C% + N%) is over 7. Thus, it is apparent that Ti is distinguished from Zr in its effect on oxidation resistance and scale adhesion of the ferritic stainless steel.

EXAMPLE 2

FIG. 1 of the attached drawing shows the results of tests for investigating the effect of Zr content and the ratio of (Zr%)/(C% + N%) on weldability. The test was conducted on Samples Nos. 7, 8, 9, 11, 13, 15, 17, 18, 19, 21, 22 and 23 of Example 1. The specimens were welded through a TIG welding process including a current supply of 50A and a welding rate of 30 cm/min., and then the specimens were bent 180° with a bend diameter of 2 t (t: thickness). The weldability was evaluated for each four test pieces in terms of the ratio of the number of cracked pieces to the number of test pieces tested.

As is apparent from the data shown in FIG. 1, the weldability is remarkably improved when the ratio of (Zr%)/(C% + N%) is greater than 7, preferably greater than 10 (Samples Nos. 11, 13, 15, 17, 18, and 19). The comparative steels containing Ti (Samples Nos. 21, 22, 23) do not show any improvement in weldability even when the ratio of (Ti%)/(C% + N%) is greater than 7.

EXAMPLE 3

Figure 2:
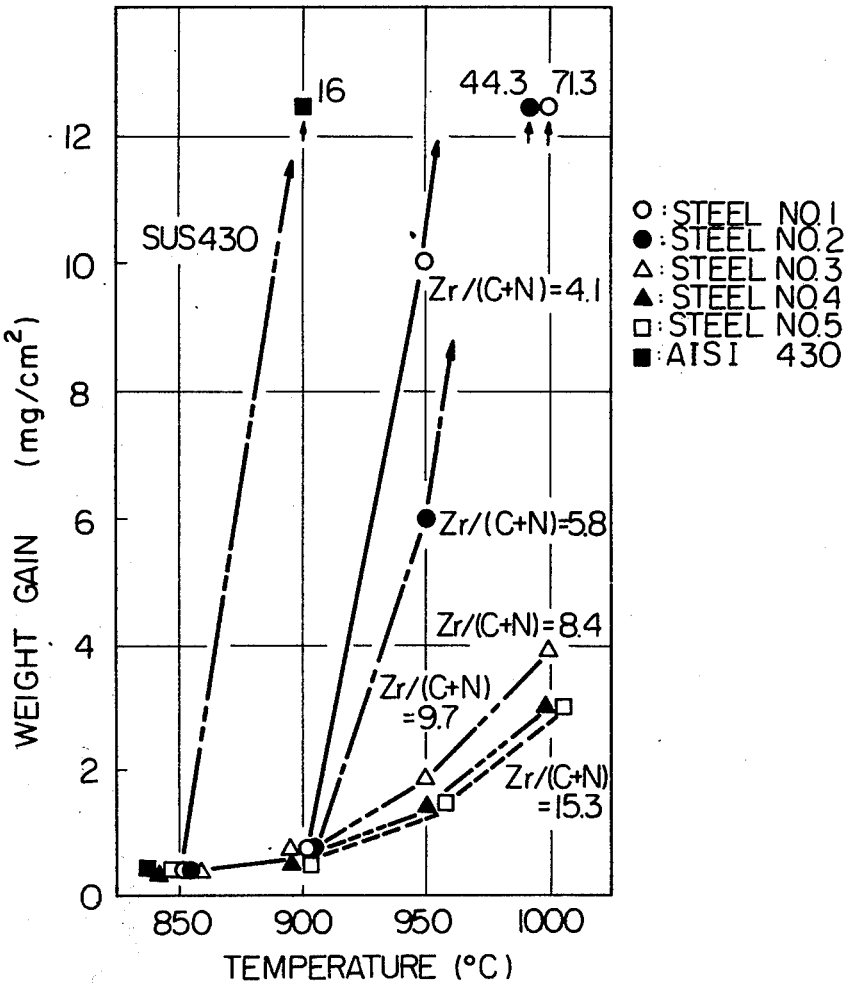

Example 1 was repeated except that samples have the chemical compositions shown in Table 2 and that test pieces heated at indicated temperatures for 250 hours. The high temperature resistance of the present invention steel was evaluated in terms of weight gains. The test results are shown in FIG. 2 of the drawing. The present invention steel in which the ratio of (Zr%)/(C% + N%) is not less than 7 can show improved high resistance to high temperature oxidation.

Table 2

| Steel No. | Chemical composition (% by weight) C | Si | Mn | Cr | Zr | N | Zr/(C+N) | |
|---|---|---|---|---|---|---|---|---|
| 1 | 0.036 | 0.69 | 0.48 | 17.91 | 0.18 | 0.008 | 4.1 | comparative |
| 2 | 0.028 | 0.69 | 0.48 | 17.77 | 0.21 | 0.008 | 5.8 | " |
| 3 | 0.037 | 0.73 | 0.51 | 18.07 | 0.37 | 0.007 | 8.4 | |
| 4 | 0.029 | 0.70 | 0.49 | 18.06 | 0.34 | 0.006 | 9.7 | |
| 5 | 0.031 | 0.89 | 0.48 | 17.80 | 0.58 | 0.007 | 15.3 | |
| SUS 430 (AISI 430) | 0.06 | 0.47 | 0.57 | 16.16 | — | 0.021 | — | conventional |

In conclusion, the present invention alloys of ferritic stainless steels are unexpectedly improved in high temperature oxidation resistance and scale adhesion as well as in weldability compared to the conventional ferritic stainless steels. Due to the improved oxidation resistance, the present invention steels may hold up under the severe conditions found in such applications as in the exhaust gas converter of automobiles. In addition, the present invention steels have a wide variety of applications such as for use in heating furnace or heating apparatus, combustion apparatus or other applications which require complicated working and welding, as well as high temperature resistance.

What is claimed is:

1. A Zr-containing ferritic stainless steel having improved weldability and oxidation resistance at high temperature, consisting of, in weight percent,
Cr from 11.0 to 20.0,
C less than 0.10,
Si less than 1.5,
Mn less than 1.5,
Zr less than 1.5,
Zr/(C+N) higher than 7,
N less than 0.015,
Fe and incidental impurities balance,
and wherein the said amount of Zr is in excess of the stoichiometric amount of the total of C and N.

2. A Zr-containing ferritic stainless steel as defined in claim 1, in which C is from 0.001 to 0.10.

3. A Zr-containing ferritic stainless steel as defined in claim 1:
Cr 17.99,
C 0.042,
Si 0.60,
Mn 0.57,
Zr 0.93,
Zr/(C+N) 19.0,
N 0.007,
Fe and incidental impurities balance.

4. A Zr-containing ferritic stainless steel as defined in claim 1:
Cr 16.58,
C 0.004,
Si 0.51,
Mn 1.41,
Zr 0.21,
Zr/(C+N) 23.3,
N 0.005,
Fe and incidental impurities balance.

5. A Zr-containing ferritic stainless steel as defined in claim 1:
Cr 18.07,
C 0.037,
Si 0.73,
Mn 0.51,
Zr 0.37,
Zr/(C+N) 8.4,
N 0.007,
Fe and incidental impurities balance.

6. A Zr-containing ferritic stainless steel as defined in claim 1:
Cr 18.06,
C 0.029,
Si 0.70,
Mn 0.49,
Zr 0.34,
Zr/(C+N) 9.7,
N 0.006,
Fe and incidental impurities balance.

7. A Zr-containing ferritic stainless steel as defined in claim 1:
Cr 17.80,
C 0.031,
Si 0.89,
Mn 0.48,
Zr 0.58,
Zr/(C+N) 15.3,
N 0.007,
Fe and incidental impurities balance.

8. A Zr-containing ferritic stainless steel as defined in claim 1, in which the ratio of (Zr%)/(C% + N%) is higher than 10.

* * * * *